US005125545A

United States Patent [19]

Passalacqua

[11] Patent Number: 5,125,545

[45] Date of Patent: Jun. 30, 1992

[54] PUMPING VALVE

[75] Inventor: Vincent Passalacqua, Yonkers, N.Y.

[73] Assignee: Makk-O Industries, Inc., Yonkers, N.Y.

[21] Appl. No.: 723,486

[22] Filed: Jul. 1, 1991

[51] Int. Cl.[5] ..... B65D 88/54

[52] U.S. Cl. ..... 222/341; 222/383

[58] Field of Search ..... 222/340, 341, 372, 378, 222/383, 385; 417/552, 553, 555.1

[56] References Cited

U.S. PATENT DOCUMENTS

| | | | |
|---|---|---|---|
| 1,264,554 | 4/1918 | Peron | 222/385 |
| 1,896,624 | 2/1933 | Hollands | 222/341 X |
| 2,105,646 | 1/1938 | Goldfarb et al. | 222/372 X |
| 2,106,620 | 1/1938 | Nilson | 222/378 X |
| 2,423,220 | 7/1947 | Arpin | 222/383 X |
| 2,534,504 | 12/1950 | Engstrom | 222/341 X |
| 4,953,758 | 9/1990 | Passalacqua | 222/383 X |

*Primary Examiner*—Kevin P. Shaver
*Attorney, Agent, or Firm*—Darby & Darby

[57] ABSTRACT

A valve for pumping a viscous fluid from a holding container includes a valve body having a fluid chamber, and a piston displaceable in the fluid chamber for pumping fluid from the fluid chamber through an outlet openings. The piston is attached to the end of a shaft which extends out of the valve. A hub with a plurality of openings and a resilient washer on its peripheral edge are slidably located on the shaft in the fluid chamber. When the piston is in contact with the hub it blocks the flow of fluid through the opening. When the hub is axially displaced from the piston, fluid is allowed to flow through the openings. Depression of the plunger causes movement of the piston away from the hub because of frontal engagement of the resilient washer with the walls of the fluid chamber. This allows the fluid to flow around the piston. Further movement of the shaft causes a projection on the shaft to engage the hub. The projection overcomes the frictional engagement and moves the hub along with, but displaced from, the piston through the chamber. The fluid contained in the chamber flows through the openings in the hub above the hub. Upon release of the plunger, a spring biases the piston upward to engage the hub and close its opening. During the movement of the piston and hub to their initial positions, under the spring bias, the fluid is pumped out of the outlet opening of the valve and substantially simultaneously enters into the lower portion of the valve chamber from the fluid-holding container.

10 Claims, 1 Drawing Sheet

PUMPING VALVE

BACKGROUND OF THE INVENTION

The present invention relates generally to a pumping valve and, in particular, to a pumping valve for pumping viscous fluid, such as cream, at atmospheric pressure from a fluid-holding container.

In the past, viscous fluids were removed from fluid-holding containers in a number of different ways. In one prior art system, the viscous fluid was maintained in a container under pressure and a simple control valve was mounted on the container. Upon opening of the valve, the pressurized fluid, e.g., cream, flowed out. However, installation of such a valve is expensive, since it required pressurizing equipment as well as necessary safety equipment usually associated with materials under pressure.

In another type of system, a pumping valve has been used. In this valve, the spout is mounted on the valve plunger and is movable with this valve plunger during the pumping action. As a result, spillage takes place since it is difficult to align the moving spout with the container.

A substantial improvement was achieved with the valve of my prior U.S. Pat. No. 4,953,758. The valve disclosed in this patent permitted pumping fluids at atmospheric pressure from a fluid-holding container with minimal or no spillage. The valve of this patent is easy to operate.

The valve disclosed in my U.S. Pat. No. 4,953,758, comprises a valve body having a valve chamber and a plunger connected to a piston that is slidably received in the valve chamber. The plunger and piston are biased by a spring toward the top of the chamber. A flexible seal is provided on the piston and is biased to a position in which it seals an exit passage of the valve. A spout is connected by a channel to the top of the chamber. A one-way check valve is provided in the valve chamber to prevent flow of fluid outwardly through the inlet opening. The depression of the plunger causes movement of the piston downward through the chamber. This causes fluid in the chamber to press down on a one-way check valve at the bottom of the chamber which prevents fluid from flowing out of the chamber and back into the container. When the check valve prevents fluid from leaving the chamber, the movement of the piston causes sufficient pressure on the flexible seal to cause it to open so that fluid below the seal flows past the seal and into the portion of the valve chamber above the seal. The release of the plunger causes movement of the plunger upward to its initial position due to the bias spring. During this upward movement the fluid is pumped out of the valve through the channel and spout. Additional fluid also enters into the bottom portion of the valve chamber from the fluid-holding container due to the vacuum created by the movement of the piston.

The valve of my U.S. Pat. No. 4,953,758, while performing quite satisfactory, is relatively complex in manufacture and assembly because it has a relatively large number of parts.

SUMMARY OF THE INVENTION

The object of the present invention is a pumping valve which is effective in operation and, at the same time, is economical in manufacture and is easily assembled.

The object of the invention is achieved by providing a valve including a plunger connected by a shaft to a piston in a fluid chamber. The top of the fluid chamber is connected by a channel to a spout. A plunger hub is slidably mounted on the plunger shaft above the piston and has a plurality of openings extending through it. When in engagement with the hub, the top of the piston seals the holes in the hub. A resilient member is mounted on the periphery of the plunger hub and a spring biases the piston and the plunger hub upwardly. The resilient member has a diameter slightly larger than the diameter of the fluid chamber, so the resilient member frictionally engages the circumferential wall of the fluid chamber.

Upon depression of the plunger, the plunger shaft and piston move downward in the fluid chamber, allowing the flow of fluid around the piston toward the upper part of the fluid chamber. However, because of the frictional engagement between the fluid chamber walls and the resilient member, the hub does not move. Instead, the plunger shaft slides through it until a pin on the shaft engages the hub and begins to push it down. With the piston out of contact with the hub, fluid flows around the piston and through the openings in the hub into the upper portion of the fluid chamber. Upon release of the plunger, a spring located in the lower portion of the fluid chamber, pushes the piston upward, and the frictional engagement of the resilient member with the walls of the fluid chamber holds the hub in place until the piston can close and seal the holes in the hub. The piston moves together with the plunger hub toward its initial position. During this movement the fluid above the hub is pumped out of the fluid chamber through the channel and spout. Substantially at the same time, additional fluid enters from the fluid-holding container into the bottom of the fluid chamber due to the vacuum created by movement of the piston/hub combination to their initial position. The plunger is received in a cavity in the upper part of the valve body. This cavity is separated from the fluid chamber by a seal which is constantly biased by a spring located in the plunger-receiving cavity. This spring also presses on the plunger to assist in biasing the plunger and piston to their initial position.

BRIEF DESCRIPTION OF THE DRAWINGS

The above-mentioned and other features and objects of this invention and the manner of obtaining the same will become more apparent and the invention itself will be best understood from the following detailed description of the preferred embodiment when read in conjunction with the accompanying drawings; wherein.

DETAILED DESCRIPTION OF THE PREFERRED EMBODIMENT

Figure 1:
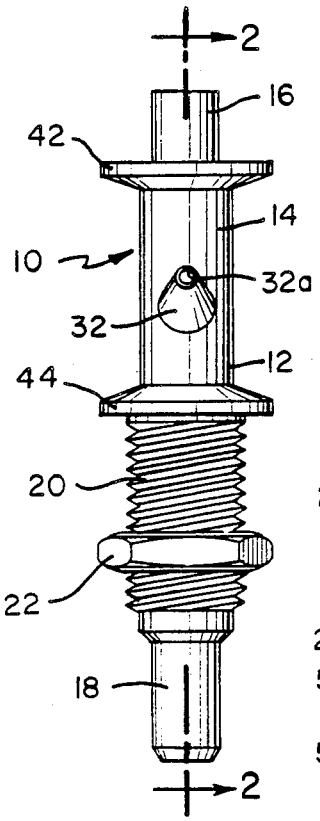
FIG. 1 is a front elevational view of the pumping valve according to the present invention.
Figure 2:
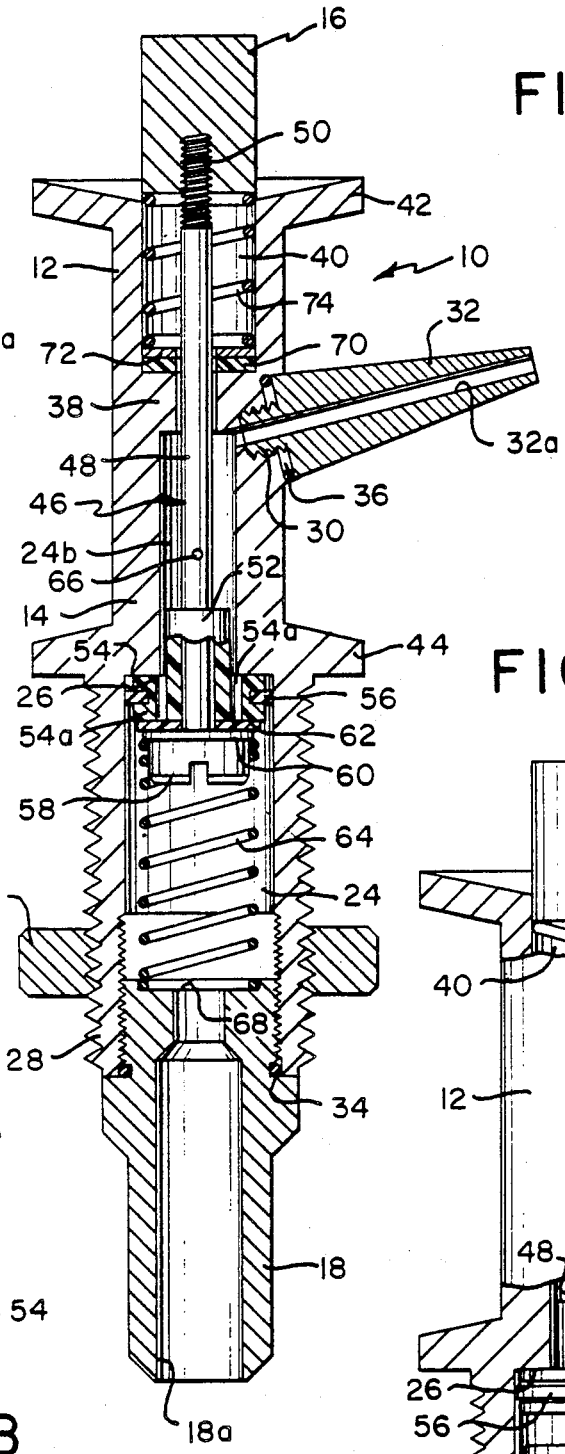
FIG. 2 is a cross-sectional view taken along line 2—2 of FIG. 1 at an enlarged scale in the initial position of the plunger.

FIG. 1 shows a pumping valve (10) for pumping fluid at atmospheric pressure from a fluid-holding container (not shown). The valve (10) comprises an elongate valve body (12) having a circumferential wall (14). A plunger or push button (16) is received in a chamber (40) at one end of the valve body (10), and a material receiving segment (18) for connecting the valve to a fluid-holding container is received at the other end of the valve body. The valve body (12) has an outer thread (20) for receiving a nut (22) for attaching the valve (10) to the fluid-holding container.

The valve body defines a fluid chamber (24) having a seat (26) separating the fluid chamber (24) from a channel (24*b*). The valve body (12) has an inner opening (28) at the nozzle receiving end with an inner thread for receiving a threaded portion of the material receiving segment (18). A side opening (30) in channel (24*b*) is provided for connecting the channel to a spout (32). The spout (32) has an internal passage (32*a*) connected with the channel (24*b*) of the fluid chamber (24). Sealing O-rings (34 and 36) are located between the nozzle (18) and the valve body (12), as well as between the spout (32) and the valve (12) respectively. The valve body (12) has an inner shoulder (38) separating the fluid flow channel (24*b*) from an axial cavity (40) for slidably receiving the plunger (16). The valve body (12) also has an upper concave circumferential flange (42 designed to facilitate grasping of the plunger (16), and lower circumferential flange (44) designed to cooperate with a gasket (not shown) to seal the valve to the fluid-holding container.

A plunger assembly (46) has a piston (58) that is displaceable in the valve chamber (24). The piston is connected to a plunger shaft (48) that extends through the channel (24*b*) and into the plunger-receiving cavity (40). The plunger shaft (48) has a threaded end portion (50) which may be threaded into an axial threaded opening of the plunger (16) for connection therewith. The plunger assembly (46) further includes a plunger hub (52) having a disk-shaped portion (54) which is slidably received on the plunger shaft (48). The disk portion (54) has a diameter which is slightly less than the diameter of the fluid chamber (24). A resilient washer (56) is circumferentially mounted on the portion (54). The diameter of the resilient washer (56) is slightly larger than the diameter of the fluid chamber (24) so that the resilient washer frictionally engages the wall (14).

The disk portion (54) has a plurality of circumferential openings (54*a*) extending therethrough. The piston further includes a sealing washer (62) for sealing the opening in the disk portion. The sealing washer (62) is fixedly mounted on the plunger shaft (48) at an upper surface of the piston (58) for joint displacement therewith. The sealing washer (62) is supported between the flange (60) of the piston (58) and the disk portion (54) of the hub (52). A spring (64) is used to bias the piston and hub into engagement with the seat (26) at the top of the fluid chamber. The spring (64) is supported in the fluid chamber (24) in the groove (68) of the surface of nozzle (18) and extend to the flange (60) of the piston (58).

The plunger-receiving cavity (40) is sealed from the fluid chamber (24) by a seal (70). To constantly bias seal (70) into engagement with the shoulder (38), a spring (74) is arranged in the cavity (40) and extends between an end surface of the plunger (16) and a washer (72) abutting the seal (70). This spring (74), along with spring (64), helps to bias the plunger assembly (46) to its initial position. The washer (72) may be the same washer disclosed in U.S. Pat. No. 4,953,758, incorporated herein by reference thereto.

Figure 3:
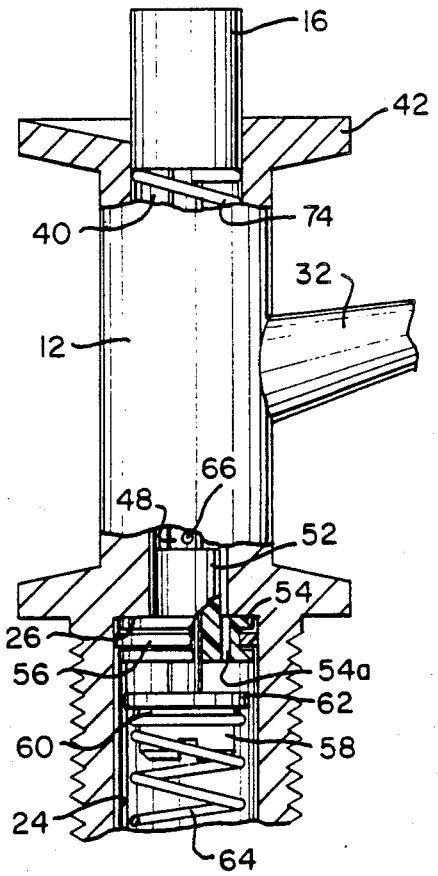
FIG. 3 is a partial cross-sectional view similar to that shown in FIG. 2, but with the plunger in an operating position in which fluid is able to flow through the openings in the hub.
Figure 4A:
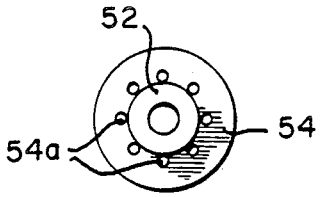
FIGS. 4A and 4B are, respectively, side and elevational views of the plunger hub.
Figure 4B:
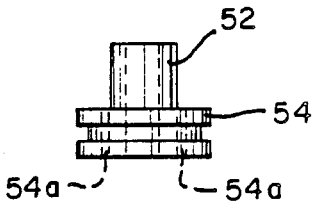

The operation of the pumping valve, according to the present invention, will be given for the sake of completeness. Upon depression of the plunger (16), the plunger assembly (46) is moved downward. This causes the piston (58), together with the sealing washer (62),to move downward, but the plunger hub (52) remains in place because of the frictional engagement of the resilient washer (56) with the walls of chamber (24). Further, downward movement of the plunger assembly (46) causes fluid in chamber (24) to flow around the piston head (58). A pin (66) in shaft (48) comes into contact with the top of hub (52) and causes hub (52) to begin to move downward. At this time, the disk portion (56) moves away from the seat (26), and the sealing washer (62) on piston (58) is away from the disk portion, as shown in FIG. 3. In this position, fluid in the fluid chamber is able to flow through the openings (54*a*) in the disk portion from the lower portion of the fluid chamber (24) toward the upper portion thereof.

Upon release of the plunger or push button (16), the plunger assembly moves in the opposite direction. As the piston continues, the sealing washer (62) on top of piston (58) abuts against the disk portion (54), blocking fluid flow though the openings (54*a*). Upon further movement of the plunger assembly (46) upward, the fluid is pumped from the upper portion of chamber (24) through the channel (24*b*) and passage (32*a*) of the spout (32) to the outside of the valve (12). At the same time, fluid from the fluid-holding container flows through the passage (18*a*) of the material receiving segment (18) into the lower portion of the fluid chamber (24) due to the vacuum created therein upon upward movement of the piston/hub combination.

While a particular embodiment of the invention has been shown and described, various modifications thereof will be apparent to those skilled in the art. Therefore, it is not intended that the invention be limited to the disclosed embodiment or the details thereof, and that departures may be made therefrom which fall within the spirit and scope of the invention as defined by the appended the claims.

What is claimed is:

1. A valve for pumping fluid comprising:

a valve body defining a fluid chamber having an inlet opening at one end and an outlet opening at the other end;

piston means located in said fluid chamber and having a diameter smaller than that of said fluid chamber, said piston means being displaceable in said fluid chamber for enabling flow of fluid through said inlet opening into said fluid chamber and for pumping the fluid past said piston means and through said outlet opening, a plunger shaft with one end extending out of said valve and the other end connected to said piston means in the fluid chamber, said plunger shaft having a projection spaced at a distance from said piston means;

a plunger hub mounted on said plunger shaft between said shaft projection and said piston for joint axial displacement with said plunger shaft, said projection on said plunger shaft being spaced sufficiently from said piston means to permit axial displacement of said hub relative of said piston for a distance and then joint axial displacement when said projection contacts said hub, and said plunger hub having at least one opening extending through said hub, means between said piston means and said hub for causing said at least one opening in said hub to be sealed against fluid flow when said piston means is in a rest position, a resilient washer supported on said plunger hub and having a diameter such that it may frictionally engage a circumferential wall of said fluid chamber to enable axial displacement of said plunger hub relative to said plunger shaft, initial movement of said plunger shaft so as to move said piston means toward said fluid chamber inlet causing fluid to flow around said piston means and displacement of said piston means relative to said hub because said hub is held against movement by the frictional engagement of said resilient washer with said fluid chamber wall, further such movement of said plunger shaft causing said projection of said plunger shaft to contact said hub and to displace said hub with said piston means whereby fluid flows around said piston means and through said at least one opening in said hub; and movement of said plunger shaft in an opposite direction so as to move said piston means toward said fluid chamber outlet causing said hub to be held against movement by frictional engagement of said resilient washer with said fluid chamber wall, further movement of said plunger shaft in said opposite direction causing said piston means to contact said hub to seal said at least one opening in said hub and to jointly displace said hub and said piston means such that the fluid is pushed out of said outlet opening.

2. A valve as set forth in claim 1, wherein said means for causing said at least one opening in the hub to be sealed comprising a sealing washer mounted on said plunger shaft between said piston means and said hub for joint axial displacement therewith, said sealing washer engaging said hub for closing said at least one opening.

3. A valve as set forth in claim 1, further comprising a valve seat at said fluid chamber outlet and spring means for biasing said piston means and said hub towards said seat.

4. A valve as set forth in claim 1, wherein said hub includes a plurality of circumferentially arranged openings extending therethrough.

5. A valve as set forth in claim 1, further including a material receiving segment with an axial channel connected to said inlet opening and having a threaded end portion, said valve body at said inlet opening having an inner threaded cavity for threadably receiving said threaded end portion of said material receiving segment, said material receiving segment being connectable to a fluid-holding container; and a spout on a side of said valve body and an outlet channel extending from said fluid chamber outlet to said spout.

6. A valve as set forth in claim 3, further comprising:

a depressible button attached to the end of the shaft extending out of said body valve; and an axial cavity defined by the valve body at an end thereof remote from the inlet opening, said axial cavity slidably receiving said depressible button.

7. A valve as set forth in claim 6, wherein said button has a bottom and a threaded inner axial opening in said bottom, and the end of the plunger shaft has outer threads cooperating with said threaded opening in the bottom for securing said button on said plunger shaft.

8. A valve as set forth in claim 6, wherein said axial cavity has a shoulder portion defining its separation from said fluid chamber, said plunger shaft extending through an opening in said shoulder portion, said valve body further including sealing means for sealing said opening in said shoulder portion against fluid flow while allowing said plunger shaft to move through said opening; and spring means located in said axial cavity between said sealing means and said bottom of said button for biasing said sealing means into engagement with said shoulder portion and biasing said button and said plunger shaft into the initial position.

9. A valve for pumping viscous fluid comprising:

a valve body defining (i) an internal fluid chamber with an inlet opening at one end thereof and an outlet opening at an opposite end, (ii) an outlet spout extending from a side wall of the valve body, (iii) an outlet channel extending from the outlet opening of the fluid chamber to the spout, and (iv) an inlet channel extending from the inlet opening of the fluid chamber in the opposite direction from the outlet opening of the fluid chamber to a valve body opening dimensioned to be received in a fluid-holding container;

a piston mounted for axial movement in the fluid chamber, the piston having a diameter less than the diameter of the fluid chamber to allow fluid to flow around it, a plunger shaft axially connected to the piston and extending axially from the piston to a position outside the valve body, the plunger shaft having a projection along the shaft spaced from the piston, a plunger hub slidably located on the shaft between the piston and the projection of the shaft, the hub having a diameter less than the diameter of the fluid chamber and defining at least one opening therethrough to allow fluid to pass through the hub, the hub having a first position in which the hub is against a surface of the piston which blocks fluid flow through the hub opening and a second position in which the hub is against the projection on the shaft and fluid flows through said at least opening in the hub; and a flexible washer mounted on peripheral edges of the hub, the washer making frictional contact with walls of the fluid chamber sufficient to hold the hub stationary in the fluid chamber despite movement of the plunger shaft unless the hub is contacted and moved by one of the piston and the projection on the shaft.

10. A valve as set forth in claim 9, further comprising means for displacing the plunger shaft such that the piston is moved from an initial position near the outlet of the fluid chamber to a final position toward the inlet end of the fluid chamber, and spring means for displacing the plunger shaft such that upon disengagement of the means for displacement, the piston is moved from the final position thereof to the initial position thereof.

* * * * *